US008451079B2

(12) United States Patent
Niimi

(10) Patent No.: US 8,451,079 B2
(45) Date of Patent: May 28, 2013

(54) ELECTROMAGNETIC SOLENOID

(75) Inventor: Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/277,541

(22) Filed: Oct. 20, 2011

(65) Prior Publication Data

US 2012/0105178 A1 May 3, 2012

(30) Foreign Application Priority Data

Oct. 28, 2010 (JP) ..... 2010-242349

(51) Int. Cl.
*H01H 67/02* (2006.01)

(52) U.S. Cl.
USPC ..... 335/126; 335/131

(58) Field of Classification Search
USPC ..... 335/126, 131
See application file for complete search history.

(56) References Cited

U.S. PATENT DOCUMENTS 4,637,267 A * 1/1987 Mazzorana ..... 74/7 A
5,023,581 A * 6/1991 Sugiyama ..... 335/126
5,214,401 A * 5/1993 Kimura et al. ..... 335/126
5,245,304 A * 9/1993 Zenmei ..... 335/126
5,424,700 A * 6/1995 Santarelli ..... 335/126
5,631,613 A * 5/1997 Niimi et al. ..... 335/126
5,663,699 A * 9/1997 Shiroyama ..... 335/126
5,679,935 A * 10/1997 Baba et al. ..... 200/17 R
7,504,917 B2 * 3/2009 Tsukada et al. ..... 335/126
2010/0033066 A1 2/2010 Murata et al.

FOREIGN PATENT DOCUMENTS

JP A-2010-67407 3/2010

* cited by examiner

*Primary Examiner* — Alexander Talpalatski
(74) *Attorney, Agent, or Firm* — Oliff & Berridge, PLC

(57) ABSTRACT

An electromagnetic solenoid having an electromagnetic coil, a fixed iron core, a movable iron core, and a spring coil. The spring coil, arranged between the fixed and the movable iron core, supplies a spring force to the movable iron core toward an opposite direction of the fixed iron core along the axial direction. A magnetic attraction surface and a fitting part are formed in at least one of the fixed iron core and the movable iron core. The magnetic attraction surface is contacted with the fixed iron core when the movable iron core reaches the fixed iron core. An outer peripheral surface of the fitting part, apart from the magnetic attraction surface by a predetermined distance along the axial direction, is engaged with the spring coil. The most outer peripheral part of the magnetic attraction surface is positioned inside rather than the most outer peripheral part of the fitting part.

17 Claims, 4 Drawing Sheets

ELECTROMAGNETIC SOLENOID

CROSS-REFERENCE TO RELATED APPLICATION

This application is related to and claims priority from Japanese Patent Application No. 2010-242349 filed on Oct. 28, 2010, the contents of which are hereby incorporated by reference.

BACKGROUND OF THE INVENTION

1. Field of the Invention

The present invention relates to electromagnetic solenoids equipped with a movable iron core, capable of generating electromagnetic force generated by an electromagnetic coil in order to move a movable iron core.

2. Description of the Related Art

There has been widely known and used an electromagnetic solenoid comprised of an electromagnetic coil, a fixed iron core, a movable iron core and a spring coil. The electromagnetic coil makes an electromagnet when receiving electric power. The fixed iron core is magnetized by a magnetic field generated by the electromagnetic coil. The movable iron core is moved to the fixed iron core magnetized along an axial direction of the electromagnetic solenoid.

The spring coil is arranged between the fixed iron core and the movable iron core so as to supply a spring force to the movable iron core in order to separate the movable iron core from the fixed iron core. After the movable iron core is moved to the fixed iron core by the electromagnet generated when electric power is supplied to the electromagnetic coil, this structure makes it possible to separate the movable iron core from the fixed iron core by the spring force of the spring coil along the axial direction opposite to the fixed iron core.

By the way, there is a phenomenon or interference in which an operational voltage to move the movable iron core is increased more than a designed voltage and the operational voltage is fluctuated every time of detecting it, namely, the operational voltage is unstable.

This means that a magnetic flux is generated in the electromagnetic coil and makes a magnetic path which is composed of the electromagnetic coil, the movable iron core and the fixed iron core. A magnetic flux leaked from the magnetic path generates a force to attract the spring coil arranged between the movable iron core and the fixed iron core toward the inside of the diameter direction of the electromagnetic solenoid, namely toward the magnetic path. As a result, the spring coil attracted toward the inside of the diameter direction of the electromagnetic solenoid interferes with the movable iron core and acts as a resistance against the movable iron core. Accordingly, when the spring coil interferes with the movable iron core, it is difficult to attract the movable iron core to the fixed iron core by using the operational voltage originally calculated by design work. From this viewpoint, it is necessary to supply an increased operational voltage, which is higher than the originally designed operational voltage determined by design work, to the electromagnetic coil in order to forcedly move the movable iron core.

In general, when the spring coil is compressed by a force supplied to both ends of the spring coil, the spring coil is compressed while shifting toward the diameter direction of the spring coil. This compression changes a distance between a position on the spring coil and the movable iron core and the distance along the diameter direction is thereby not constant. Accordingly, the magnitude of such interference from the spring coil to the movable iron core is varied or fluctuated according to a part of the spring coil, and the operation of the movable iron core is thereby unstable.

Furthermore, in an electromagnetic solenoid having a movable iron core, for example, disclosed in Japanese patent laid open publication No. 2010-67407, the movable iron core has a taper part which projects toward a fixed iron core along an axial direction from a magnetic attraction surface of the movable iron core at which the movable iron core and the fixed iron core are contacted together when the movable iron core is attracted to the fixed iron core, and because more attraction force to attract the spring coil in the inside of the diameter direction of the electromagnetic solenoid is generated, an operational voltage to move the movable iron core is more increased.

The electromagnetic solenoid having the above structure is applied to various fields, for example, is used as a pinion gear pushing solenoid in a starter device capable of starting an internal combustion engine. In particular, in the automobile field, it is necessary to guarantee the minimum operational voltage in order to correctly move the movable iron core because the electromagnetic solenoid is requested to be correctly operate even if it works under severe conditions such as high temperature and large vibration conditions.

SUMMARY OF THE PRESENT INVENTION

It is an object of the present invention to provide an electromagnetic solenoid which is operable by a stable operational voltage.

To achieve the above purposes, the present exemplary embodiment provides an electromagnetic solenoid having electromagnetic coil, a fixed iron core, a movable iron core and a spring coil. The electromagnetic coil forms an electromagnet when receiving electric power. The fixed iron core is arranged at one end part of the electromagnetic coil and magnetized when electric power is supplied to the electromagnetic coil. The movable iron core is moved along the axial direction in the inside of the electromagnetic coil to and from the fixed iron core. The spring coil is placed between the fixed iron core and the movable iron core and supplies a spring force to the movable iron core toward an opposite direction of the fixed iron core along the axial direction. In the electromagnetic coil, a magnetic attraction surface and a fitting part are formed in at least one of the fixed iron core and the movable iron core. The magnetic attraction surface is contacted with the other iron core when the movable iron core is attracted to and contacted with the fixed iron core. An outer peripheral surface of the fitting part, apart from the magnetic attraction surface by a predetermined distance in the direction opposite to the fixed iron core along the axial direction is engaged with the spring coil. The most outer peripheral part of the magnetic attraction surface is positioned inside in the diameter direction rather than the most outer peripheral part of the fitting part.

In the structure of the electromagnetic solenoid, because the most outer peripheral part of the magnetic attraction surface is positioned inside in the diameter direction rather than the most outer peripheral part of the fitting part, it is possible to fix the position of the spring coil in the diameter direction and to suppress the spring coil from being moved in the diameter direction by the most outer peripheral part of the fitting part. This makes it possible to prevent the interference supplied from the spring coil to the most outer peripheral part of the magnetic attraction surface. Accordingly, the present invention provides the electromagnetic solenoid with a stable operational voltage which is necessary to move the movable iron core without fluctuation.

In the electromagnetic solenoid according to the present invention, a small-diameter part is formed between the magnetic attraction surface and a side part of the fitting part which faces the magnetic attraction surface. The small-diameter part is smaller in diameter than the fitting part. Further, the small-diameter part has a decreased-diameter surface as an outer peripheral surface formed between the end part of the fitting part facing the magnetic attraction surface and the most outer peripheral part of the magnetic attraction surface. The decreased-diameter surface has a tapered shape which is decreased in diameter toward the magnetic attraction surface along the axial direction or has an outer peripheral surface along the axial direction of the movable iron core.

Because the small-diameter part is formed between the magnetic attraction surface and the side part of the fitting part which faces the magnetic attraction surface and the small-diameter part is smaller in diameter than the fitting part, it is possible for this structure to keep the distance in the small-diameter part between the inner surface of the spring coil and the movable iron core. This structure makes it possible to prevent the interference supplied from the spring coil to the most outer peripheral part of the magnetic attraction surface. Accordingly, the present invention provides the electromagnetic solenoid with a stable operational voltage which is necessary to move the movable iron core.

In the electromagnetic solenoid according to the present invention, the small-diameter part has a cylindrical shape having the outer peripheral surface along the axial direction in which the movable iron core moves.

Because, the small-diameter part has a cylindrical shape having the outer peripheral surface along the axial direction through which the movable iron core moves, it is possible to decrease the change of the distance between the outer peripheral surface of the small-diameter part and the spring coil. This makes it possible to prevent the interference provided from the spring coil to the most outer peripheral part of the magnetic attraction surface. Accordingly, the present invention provides the electromagnetic solenoid with a stable operational voltage which is necessary to move the movable iron core.

In the electromagnetic solenoid according to the present invention, a length of the decreased diameter surface in the axial direction is longer than a length in the diameter direction between the most outer peripheral part of the fitting part and the most outer peripheral part of the magnetic attraction surface in the movable iron core.

Because the length of the decreased diameter surface in the axial direction is longer than the length in the diameter direction between the most outer peripheral part of the fitting part and the most outer peripheral part of the magnetic attraction surface in the movable iron core, it is possible to prevent the interference from the spring coil to the most outer peripheral part of the magnetic attraction surface even if the spring coil is compressed between the movable iron core and the fixed iron core and further even if the distance between the adjacent wound wire forming the spring coil is decreased. Accordingly, the present invention provides the electromagnetic solenoid with a stable operational voltage which is necessary to move the movable iron core.

In the electromagnetic solenoid according to the present invention, one of the movable iron core and the fixed iron core has the magnetic attraction surface. The magnetic attraction surface of one of the movable iron core and the fixed iron core has a projection part having a tapered shape which projects toward the axial direction, and a hole part is formed in the magnetic attraction surface of the other iron core, and the projection part is fitted to the hole part.

One of the movable iron core and the fixed iron core has the projection part has the magnetic attraction surface of a tapered shape projecting toward the axial direction and the magnetic attraction surface of the other iron core has the hole part. Because the projection part is fitted to the hole part, it is possible to adjust the attracting force according to the distance between the movable iron core and the fixed iron core by adjusting the size and volume of the projection part. This structure makes it possible to provide the easy work to design the electromagnetic solenoid.

In the electromagnetic solenoid according to the present invention, the spring coil is made of magnetic material.

Because the spring coil is made of magnetic material, the attracting force is generated in the axial direction of the spring coil between the adjacent wound wire forming the spring coil when the electromagnetic coil receives electric power. It is thereby possible to suppress the attracting force generated between the movable iron core and the fixed iron core from being decreased even if the area of the magnetic attraction surface is decreased.

In the electromagnetic solenoid according to the present invention, a distance in the diameter direction between the most outer peripheral part of the fitting part and the most outer peripheral part of the magnetic attraction surface is not less than 0.6 times of a wire diameter of the spring coil.

Because the distance in the diameter direction between the most outer peripheral part of the fitting part and the most outer peripheral part of the magnetic attraction surface is not less than 0.6 times of a wire diameter of the spring coil, it is possible to securely prevent the interference from the spring coil to the most outer peripheral part of the magnetic attraction surface.

BRIEF DESCRIPTION OF THE DRAWINGS

A preferred, non-limiting embodiment of the present invention will be described by way of example with reference to the accompanying drawings, in which:

FIG. 4 shows comparison results when the spring coils are made of magnetic material and non-magnetic material;

DETAILED DESCRIPTION OF THE PREFERRED EMBODIMENTS

Figure 1:
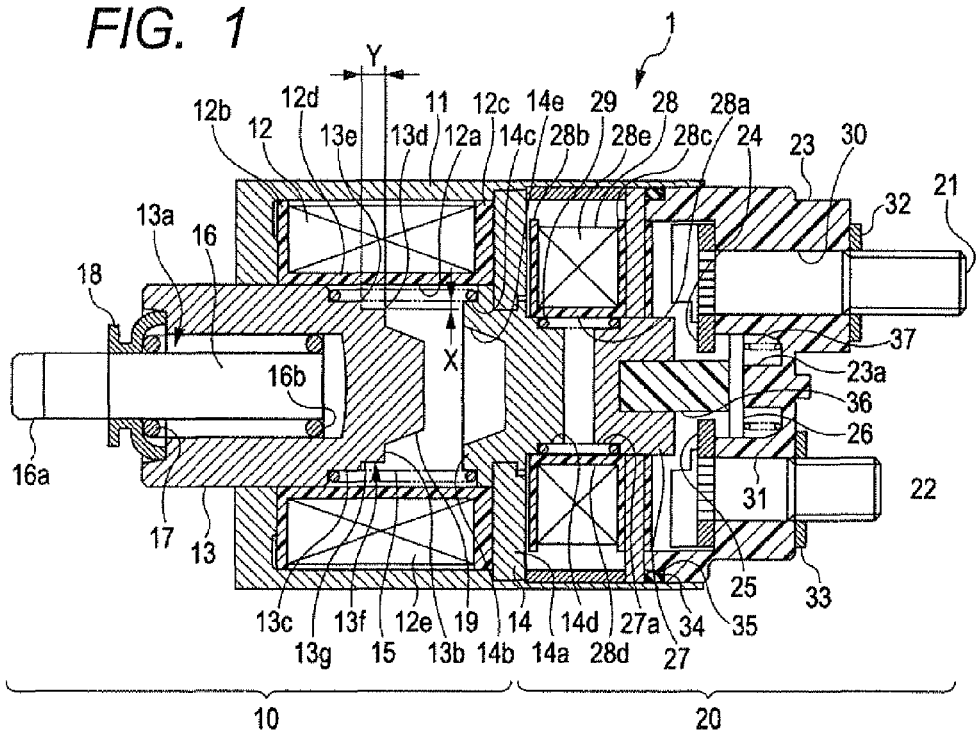
FIG. 1 is a view showing a cross section of an electromagnetic switch equipped with an electromagnetic solenoid and an electromagnetic relay according to a first exemplary embodiment of the present invention.

Hereinafter, various embodiments of the present invention will be described with reference to the accompanying drawings. In the following description of the various embodiments, like reference characters or numerals designate like or equivalent component parts throughout the several diagrams.

First Exemplary Embodiment

A description will be given of an electromagnetic solenoid 10 according to a first exemplary embodiment of the present invention with reference to FIG. 1 to FIG. 4.

The first exemplary embodiment applies the electromagnetic solenoid 10 to a starter device which starts the internal combustion engine mounted to a motor vehicle, for example. In the following description, the direction toward the right side in each diagram indicates the direction toward the starter motor, and the direction toward the left side in each diagram indicates the direction toward the pinion gear.

Figure 2:
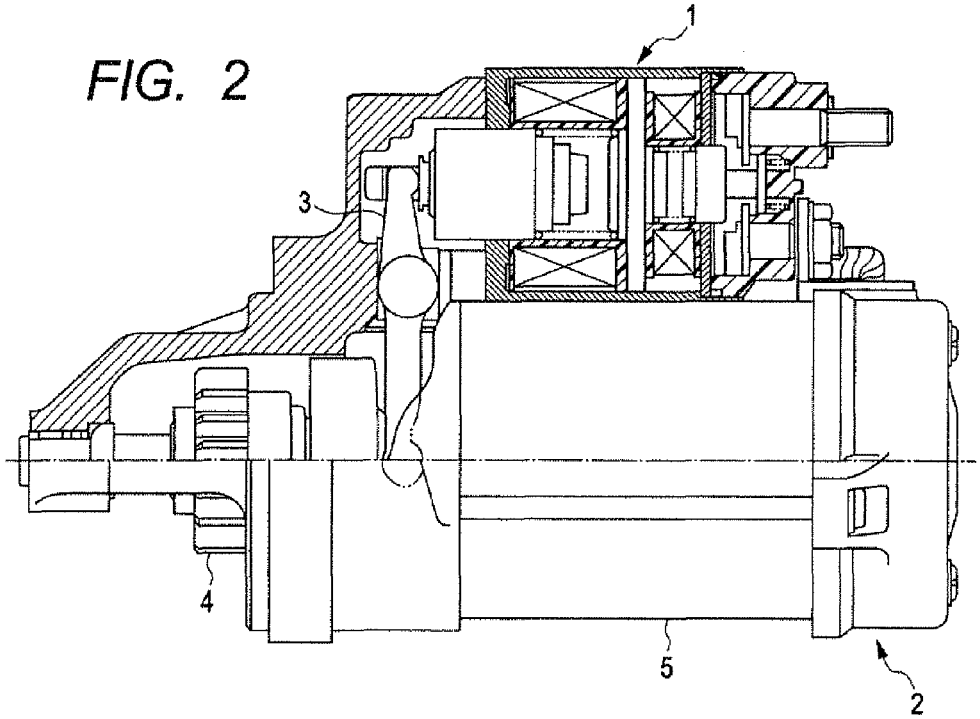
FIG. 2 is a view showing a cross section of a starter device equipped with the electromagnetic switch which is equipped with the electromagnetic solenoid and the electromagnetic relay according to the first exemplary embodiment of the present invention.

FIG. 1 is a view showing a cross section of the electromagnetic switch 1 equipped with the electromagnetic solenoid 10 and the electromagnetic relay 20 according to the first exemplary embodiment of the present invention. FIG. 2 is a view showing a cross section of a starter device equipped with the electromagnetic switch 1 having the electromagnetic solenoid 10 according to the first exemplary embodiment of the present invention.

As shown in FIG. 2, the electromagnetic switch 1 is mounted to the starter device 2 which is used for starting the internal combustion engine of a motor vehicle (not shown).

The electromagnetic switch 1 is equipped with the electromagnetic solenoid 10 and the electromagnetic relay 20. The electromagnetic solenoid 10 pushes a pinion gear 4 to a ring gear of the internal combustion engine (not shown) through a shift lever (or a gear stick) 3. The electromagnetic relay 20 allows and stops current supply to a starter motor 5.

In the electromagnetic switch 1, the electromagnetic solenoid 10 and the electromagnetic relay 20 are arranged in series along an axial direction of the electromagnetic switch 1. The electromagnetic solenoid 10 and the electromagnetic relay 20 are assembled together and stored in a switch case 11. This switch case 11 forms an outer cover case of the electromagnetic switch 1. In particular, the switch case 11 has a function to form a part of a magnetic path of the electromagnetic solenoid 10 and the electromagnetic relay 20.

When the electromagnetic switch 1 according to the first exemplary embodiment is mounted to a motor vehicle having an idle stop function, the electromagnetic switch 1 can push the pinion gear 4 and supply electric power to the motor 5, independently. The idle stop function can automatically stop the internal combustion engine of the motor vehicle when the vehicle stops at a traffic signal in order to save fuel consumption and decrease air pollution. As previously described, the electromagnetic switch 1 has both functions regarding the electromagnetic solenoid 10 and the electromagnetic relay 20.

The electromagnetic solenoid 10 is comprised of an exciting coil 12, a movable iron core 13, a fixed iron core 14, and a spring coil 15. The exciting coil 12 generates electromagnetic force when receiving electric power. The solenoid movable iron core 13 moves in the inside of the exciting coil 12 along the axial direction. The fixed iron core 14 is arranged along the axial direction near to the starter motor 5 and apart from the movable iron core 13. The spring coil 15 is arranged between the movable iron core 13 and the fixed iron core 14.

As shown in FIG. 1, the exciting coil 12 has a penetration hole 12*a* of a cylindrical shape therein, through which the movable iron core 13 is moved to and from the fixed iron core 14 along the longitudinal direction of the exciting coil 12. The exciting coil 12 further has a bobbin 12*d* having flange parts 12*b* and 12*c* at both ends of the penetration hole 12*a* when observed along the axial direction.

A conductive wire 12*e* is wound on the outer periphery of the penetration hole between the flange parts 12*b* and 12*c* in order to form an electromagnetic coil. In the structure of the electromagnetic solenoid 10 according to the first exemplary embodiment, the bobbin 12*d* is made of resin having electrical insulation. The conductive wire 12*e* is an enameled wire in which an electrical wire is covered with enamel having electrical insulation function.

The movable iron core 13 in the electromagnetic solenoid 10 is made of magnetic substance such as iron, and has a cylindrical shaped member having a bottom part. An opening part 13*a* is formed in the movable iron core 13 at the end part near to the movable iron core 13 along the axial direction.

On the other hand, a magnetic attraction surface 13*b* is formed at the other end part of the movable iron core 13, which is near to the fixed iron core 14, when the movable iron core 13 of the electromagnetic solenoid 10 moves to the starter motor and contacted with the fixed iron core 14.

The shape and function of the magnetic attraction surface 13*b* of the movable iron core 13 is one of important features of the electromagnetic solenoid 10 according to the first exemplary embodiment of the present invention. The feature of the magnetic attraction surface 13*b* of the movable iron core 13 will be explained later in detail.

A drive shaft 16 is inserted into the inside of the movable iron core 13 through the opening part 13*a*. The drive shaft 16 is engaged with the gear stick 3. A hook 16*a* is formed at one end of the drive shaft 16, and the hook 16*a* is engaged with the gear stick 3. A contact part 16*b* is formed at the other end of the drive shaft 16. The contact part 16*b* is contacted with the drive spring 17 which is formed toward the starter motor along the axial direction.

One end of the drive spring 17 is contacted with the contact part 16*b*. The other end of the drive spring 17 covers the opening part 13*a* of the movable iron core 13 of the electromagnetic solenoid 10. Further, the inner diameter part of the drive spring 17 is contacted with a cap 18 through which the drive shaft 16 is inserted. This structure makes it possible to push the pinion gear 4 toward the ring gear of the internal combustion engine (not shown) through the shift lever 3 by the electromagnetic solenoid 10. When the pinion gear 4 is contacted with the ring gear, the drive spring 17 is compressed, and the compressed drive spring 17 accumulates the compressed force therein. When the tooth of the pinion gear 4 is correctly meshed to the tooth of the ring gear, the drive spring 17 pushes the pinion gear 4 to the ring gear, and the pinion gear 4 and the ring gear are finally engaged together.

The fixed iron core 14 is comprised of a disk part 14*a* of a doughnut shape having a hole at the central part thereof and a core part 14*b*. The core part 14*b* is fitted to the hole of the disk part 14*a*. In the structure of the electromagnetic switch 1 equipped with the electromagnetic solenoid 10 and the electromagnetic relay 20 shown in FIG. 1, the disk part 14*a* is comprised of a plurality of thin plates and the thin plates are stacked. The structure of the core part 14*b* is one of the features of the electromagnetic switch 1 according to the present invention, and the explanation thereof will be described later in detail.

The spring coil 15 is a compression spring composed of a wound wire. The one end and the other end of the spring coil 15 are engaged with the engagement part 13*c* formed in the movable iron core 13 and the engagement part 14*c* formed in the fixed iron core 14, respectively. The spring coil 15 supplies the spring force to the movable iron core 13 so that the movable iron core 13 is separated from the fixed iron core 14 toward the pinion gear along the axial direction of the electromagnetic solenoid 10. For example, the spring coil 15 is made of magnetic material such as iron.

Next, a description will now be given of the electromagnetic relay 20.

The electromagnetic relay 20 is comprised of two terminal bolts 21 and 22, a contact cover 23, a pair of fixed contact parts 24 and 25, a movable contact 26, a switch coil 28, a movable iron core 27 of the switch coil 28, the fixed iron core 14, and a switch return spring 29. In particular, the fixed iron core 14 is also the component forming the electromagnetic solenoid 10. Thus, the fixed iron core 14 is commonly used by both the electromagnetic solenoid 10 and the electromagnetic relay 20.

The two terminal bolts 21 and 22 are connected to an electric power supply circuit of the motor 5. The terminal bolts 21 and 22 are fixed to the contact cover 23. The two terminal bolts 21 and 22 and the pair of the fixed contact parts 24 and 25 are assembled together. The movable contact 26 electrically connects the fixed contact parts 24 and 25 together, and electrically disconnects the fixed contact part 24 from the fixed contact part 25. The movable iron core 27 of the switch coil 28 drives the movable contact 26. The switch coil 28 generates electromagnetic force when receiving electric power. The fixed iron core 14 is placed near to the pinion gear 28 when observed along the axial direction from the switch coil 28 and apart from the movable iron core 27. The switch return spring 29 is placed between the movable iron core 27 and the fixed iron core 14. In the electromagnetic switch 1 shown in FIG. 1, the electromagnetic solenoid 10 and the electromagnetic switch 20 use the fixed iron core 14 as a part of the magnetic circuit.

The terminal bolds 21 and 22 are inserted into and fixed to the bold holes 30 and 31 formed in the contact cover 23 so that the fixed contacts 24 and 25 are placed toward the pinion gear along the axial direction. Washers 32 and 33 are fixed to the terminal bolts 21 and 22 and the contact cover 23 so that the washers 32 and 33 are contacted with the side surface of the contact cover 23 along the axial direction of the starter motor when observed from the direction opposite to the fixed contacts 24 and 25

The contact cover 23 is made of insulation resin and has a groove 35 along the outer periphery of the contact cove. A character "O" shaped ring (such as O-ring) 34 made of rubber is fitted to the groove 35. The contact cover 23 is assembled to the opening part of an electromagnetic switch case 11. The inner circumferential surface of the electromagnetic switch case 11 and the outer periphery of the contact cover 23 are sealed with the O-ring 34.

The fixed contacts 24 and 25 form the fixed contact pair which is electrically connected and disconnected by the movable contact 26. The fixed contacts 24 and 25 are forcedly inserted to at the front part of the terminal bolds 21 and 22, as shown in FIG. 1.

The switch coil 28 has a penetration hole 28*a* of a cylindrical shape formed in the central part thereof. Through the inner circumferential surface of the penetration hole 28*a* of the switch coil 28, the movable iron core 27 moves. The switch coil 28 further has the bobbin 28*d* having flange parts 28*b* and 28*c*. A conductive wire 28*e* is wound on the outer peripheral surface of the penetration hole between the flange parts 28*b* and 28*c*. In the structure of the electromagnetic switch 1 equipped with the electromagnetic solenoid 10 and the electromagnetic relay 20 according to the first exemplary embodiment shown in FIG. 1, the bobbin 28*d* is made of insulation resin. The conductive wire 28*e* is an enameled wire in which an electrical wire is covered with enamel having electrical insulation function.

The movable contact 26 and the movable iron core 27 of the electromagnetic switch are commonly moved along the axial direction by a rod-shaped plunger shaft 36. The movable contact 26 is arranged near to the contact cover 23 along the axial direction of the fixed contacts 24 and 25. A contact spring 37 is placed between the contact cover 23 and the movable iron core 26 near to the pinion gear along the axial direction when observed from the movable contact 26. The contact spring 37 forcedly presses the movable contact 26 toward the pinion gear (not shown).

The switch return spring 29 is a compression spring coil formed by winding a wire. One end of the switch return spring 29 is fitted to a fitting part 27*a* of the movable iron core 27 and the other end of the switch return spring 29 is fitted to the fitting part 14*d* formed in the fixed iron core 14. The switch return spring 29 forcedly pushes the movable iron core 27 toward the starter motor (not shown) along the axial direction of the electromagnetic switch 1 so that the movable iron core 27 is separated from the fixed iron core 14. The switch return spring 29 forcedly pushes the movable iron core 26 so that the movable iron core 26 is contacted with a convex part 23*a* formed on the inner bottom surface of the contact cover 23 while the contact spring 37 is compressed. In the structure of the electromagnetic switch 1 according to the first exemplary embodiment shown in FIG. 1, the switch return spring 29 is made of magnetic material such as iron or steel.

Next a description will now be given of the features of the electromagnetic switch 1 equipped with the electromagnetic solenoid 10 and the electromagnetic relay 20 according to the first exemplary embodiment shown in FIG. 1, FIG. 3 and FIG. 4.

At least one of the movable iron core 13 and the fixed iron core 14 has the magnetic attraction surface 13*b* and the fitting part 13*c*. In particular, the most outer peripheral part 13*d* of the magnetic attraction surface 13*b* is positioned inside rather than the most outer peripheral part 13*e* of the fitting part 13*c*, as shown in FIG. 1. The magnetic attraction surface 13*b* formed on at least one of the movable iron core 13 and the fixed iron core 14 is contacted with the other iron core. When electric power is supplied to the exciting coil 12, the movable iron core 13 is attracted to and contacted with the fixed iron core 14. The fitting part 13*c* is fitted to the spring coil 15 which is wound on the outer periphery. The spring coil 15 is formed apart from the magnetic attraction surface 13*b* by a predetermined distance. This structural feature of the electromagnetic switch 1 equipped with the electromagnetic solenoid 10 and the electromagnetic relay 20 will now be explained in detail.

When electric power is supplied to the exciting coil 221 and the movable iron core 12 is attracted to and contacted with the fixed iron core 14, the magnetic attraction surface 13*b* formed on the movable iron core 13 of the electromagnetic solenoid 10 is contacted with the fixed iron core 14. The fitting part 13*c* is fitted to the coil sprig 15. The fitting part 13*c* is formed on the outer peripheral surface of the movable iron core 13, where the outer peripheral surface is opposite to the magnetic attraction surface 13*b* of the movable iron core 13. The fitting part 13*c* has a cylindrical shape and formed on the outer peripheral surface of the movable iron core 13.

Further, the most outer peripheral part 13*d* of the magnetic attraction surface 13*b* is positioned inside rather than the most outer peripheral part 13*e* of the fitting part 13*c*, as shown in FIG. 1. That is, as shown in FIG. 1, a gap "X" is formed between the most outer peripheral part 13*d* of the magnetic attraction surface 13*b* and the most outer peripheral part 13*e* of the fitting part 13*c*.

In the structure of the electromagnetic switch 1 equipped with the electromagnetic solenoid 10 and the electromagnetic relay 20 according to the first exemplary embodiment shown in FIG. 1, a small-diameter part 13*f* is formed between the magnetic attraction surface 13*b* and the side part of the fitting part 13*c* which is toward the direction of the fixed iron core 10 and the magnetic attraction surface 13*b*. The small-diameter part 13*f* is smaller in diameter than the fitting part 13*c*.

The outer diameter of the small-diameter part 13*f* has the same diameter as the most outer peripheral part 13*d* of the magnetic attraction surface 13*b*. A decreased-diameter surface 13*g* (or a decreased-diameter part) is formed parallel to the movable axis of the movable iron core 13 of the electromagnetic solenoid 10, where the decreased-diameter surface 13*g* is an outer peripheral surface of the movable iron core 13 at which the most outer peripheral part 13*d* of the magnetic attraction surface 13*b* and the most outer peripheral part 13*e* of the fitting part 13*c* are connected together. That is, the outer diameter of the small-diameter part 13*f* is smaller twice of the gap "X" than the outer diameter of the most outer peripheral part 13*e* of the fitting part 13*c*. In addition, the length "Y" of the small-diameter part 13*f* in the axial direction of the electromagnetic switch 1 is longer than the gap "X".

The magnetic attraction surface 13*b* of the movable iron core 13 of the electromagnetic solenoid 10 has a projection part 19 which faces the fixed iron core 14. The projection part 19 of the magnetic attraction surface 13*b* has a tapered shape. A concave part or a hole part 14*e* is formed in the core part 14*b* of the fixed iron core 14. The hole part 14*e* of the fixed iron core 14 faces the movable iron core 13 of the electromagnetic solenoid 10. The projection part 19 is inserted and fitted to the hole part 14*e* of the fixed iron core 14.

In the structure of the electromagnetic switch 1 equipped with the electromagnetic solenoid 10 and the electromagnetic relay 20 according to the first exemplary embodiment shown in FIG. 1, when the movable iron core 13 is attracted to the fixed iron core 14 and the magnetic attraction surface 13*b* of the movable iron core 13 is contacted with the fixed iron core 14, the surface of the projection part 19 having a tapered shape is not contacted with the inner surface p the hole part 14*e* of the fixed iron core 14.

A description will now be given of the actions and effects of the electromagnetic switch 1 equipped with the electromagnetic solenoid 10 and the electromagnetic relay 20 according to the first exemplary embodiment.

When a request to push the pinion gear 4 is transferred to the electromagnetic solenoid 10, a predetermined voltage as electric power is supplied to the exciting coil 12. The exciting coil 12 generates electromagnetic force, and thereby makes a magnetic path which passes through the exciting coil 12, the fixed iron core 14, the movable iron core 13 of the electromagnetic solenoid 10 and the switch case 11. The movable iron core 13 of the electromagnetic solenoid 10 is attracted to the fixed iron core 14 by the electromagnetic force generated in the exciting coil 12. That is, the movable iron core 30 is moved to the fixed iron core 14 against the spring force of the spring coil 15.

The spring coil 15 arranged between the movable iron core 13 of the electromagnetic solenoid 10 and the fixed iron core 14 is compressed between the movable iron core 13 and the fixed iron core 14. Further, the spring coil 15 is attracted toward the inside of the electromagnetic switch 1 along the diameter direction, namely, in the direction of the outer peripheral part 13*d* of the magnetic attraction surface 13*b* by the magnetic flux which passes between the fixed iron core 14 and the magnetic attraction surface 13*b* of the movable iron core 13 of the electromagnetic solenoid 10.

When the outer peripheral part 13*d* of the magnetic attraction surface 13*b* is not positioned inside the most outer peripheral part 13*e* of the fitting part 13*c*, the interference generated by the spring coil 15 is supplied to the outer peripheral part 13*d*. This structure requires a high operational voltage rather than the operational voltage which is set in advance in design work in order to move the movable iron core 13 of the electromagnetic solenoid 10.

As previously described, in the structure of the electromagnetic switch 1 equipped with the electromagnetic solenoid 10 and the electromagnetic relay 20 shown in FIG. 1, the most outer peripheral part 13*d* of the magnetic attraction surface 13*b* is positioned inside rather than the position of the most outer peripheral part 13*e* of the fitting part 13*c*. This improved structure makes it possible to prevent the spring coil 15 from being moved toward the inside in the radial direction of the electromagnetic switch 1 by the most outer peripheral part 13*e* of the fitting part 13*c*. Further, this structure of the electromagnetic switch 1 shown in FIG. 1 makes it possible to prevent interference from the spring coil 15 to the outer peripheral part 13*d* of the magnetic attraction surface 13*b*.

Because the movable iron core 13 in the electromagnetic solenoid 10 is attracted to and contacted with the fixed iron core 14 without interference supplied from the spring coil 15 toward the inside along the diameter direction in the structure of the electromagnetic switch 1 shown in FIG. 1, this makes it possible to prevent the operational voltage of the movable iron core 13 from being increased.

Next, a description will now be given of the experimental results which shows the above effects of the electromagnetic switch 1 equipped with the electromagnetic solenoid 10 and the electromagnetic relay 20 according to the first exemplary embodiment with reference to FIG. 3 and FIG. 4.

Figure 3:
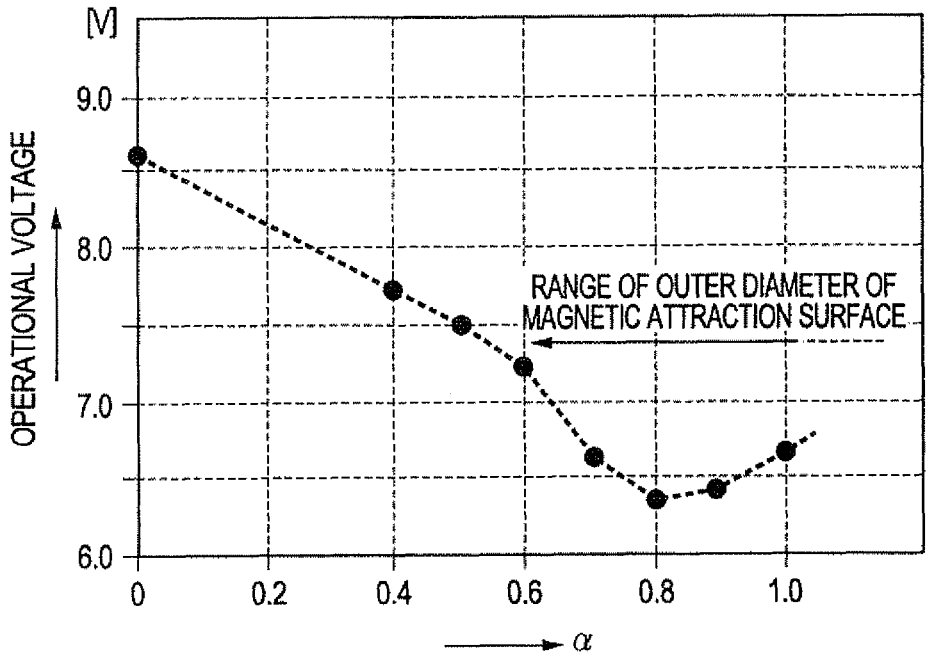
FIG. 3 is a graph showing a relationship between a gap X, a diameter of a coil forming a spring coil, and an operational voltage of the movable iron core of the electromagnetic solenoid according to the first exemplary embodiment of the present invention.

FIG. 3 is a graph showing a relationship between the gap X, a diameter of a coil forming the spring coil 15, and an operational voltage to move the movable iron core 13 of the electromagnetic solenoid 10 according to the first exemplary embodiment of the present invention. FIG. 4 is a graph showing a relationship between the gap X, the diameter of the coil forming the spring coil 10, and the operational voltage to move the movable iron core 13 of the electromagnetic solenoid 10 according to the first exemplary embodiment of the present invention.

In FIG. 3, the horizontal line indicates a rate obtained by dividing the gap X with a diameter of the wire forming the spring coil 15, where the gap X is a distance between the outer peripheral part 13*d* of the magnetic attraction surface 13*b* and the most outer peripheral part 13*e* of the fitting part 13*c*. In other words, the horizontal axis indicates that the gap X is what times of the diameter of the wire forming the spring coil 15. The obtained ratio will be referred to as the "value $\alpha$". The vertical axis in FIG. 3 and FIG. 4 indicates the operational voltage to move the movable iron core 13 of the electromagnetic solenoid 10. That is, when the spring coil is made of wire having a constant diameter, the more the value $\alpha$ is increased, the more the gap X is increased, and the more the area of the magnetic attraction surface 13*b* of the movable iron core 13 is decreased.

When the value of the horizontal line is zero, namely, the gap X is zero, and the most outer peripheral part 13*d* of the magnetic attraction surface 13*b* and the most outer peripheral part 13*e* of the fitting part 13*c* are aligned in the diameter direction of the electromagnetic switch 1 to each other, the operational voltage of 8.7 V is required to move the movable iron core 13 of the electromagnetic solenoid 10. When the value α is gradually increased, this operational voltage is gradually decreased. When the value α is further increased and exceeds 0.6, the operational voltage is rapidly changed, as shown in FIG. 3. That is, when the value α exceeds 0.6, the change rate of the operational voltage is increased, and when the value α exceeds 0.8, the operational voltage is increased again, as shown in FIG. 3.

The above-described phenomenon can be considered as follows:

When the value α is increased, the interference of the coil spring 15 to the movable iron core 13 of the electromagnetic solenoid 10 is decreased. When the value α is 0.6, the interference of the spring coil 15 to the movable iron core 13 is removed. When the value α exceeds 0.8, the operational voltage to move the movable iron core 13 is increased because the absorbing force of the magnetic attraction surface 13*b* is decreased by decreasing the area of the magnetic attraction surface 13*b* although no interference is generated from the spring coil 15 to the movable iron core 13.

Accordingly, the electromagnetic solenoid 10 according to the first exemplary embodiment has the value α within a range of 0.6 to 0.8.

Figure 4:
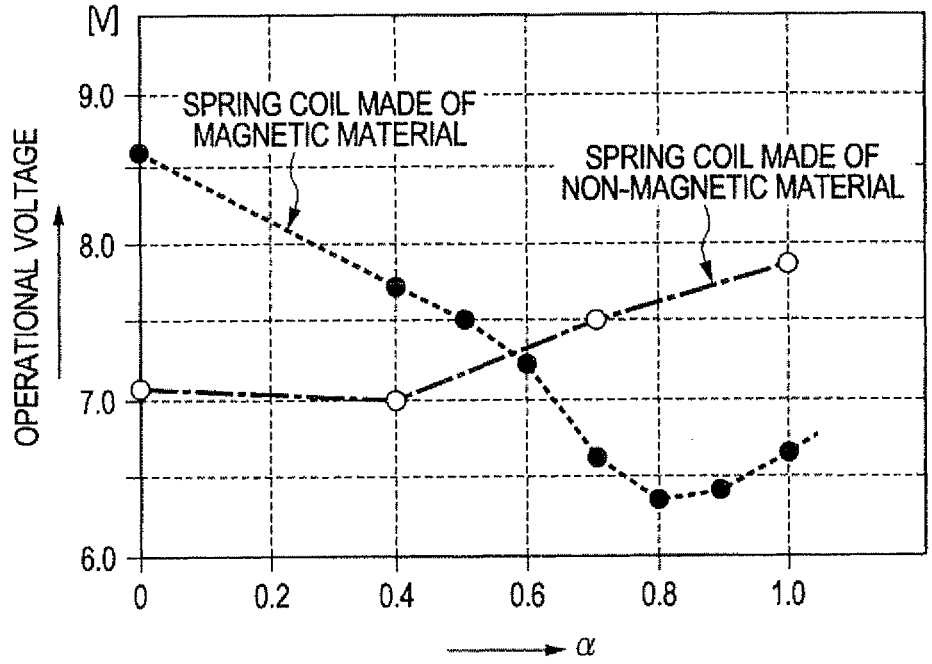
FIG. 4 is a graph showing a relationship between the gap X, the diameter of the coil forming the spring coil, and the operational voltage to move the movable iron core of the electromagnetic solenoid according to the first exemplary embodiment of the present invention.

FIG. 4 shows the comparison results when the spring coil is made of magnetic material (or non-magnetic substance) and the spring coil is made of non-magnetic material (or non-magnetic substance). By the way, FIG. 3 shows the detection results when the spring coil 15 is made of magnetic material, as previously described. The spring coil made of non-magnetic material and the spring coil made of magnetic material have the same spring coil when these spring coils have the same diameter.

As compared with the operational voltage when the spring coil 15 is made of magnetic material, the operational voltage is low when the spring coil 15 is made of non-magnetic material even if the value α is zero (α=0) because the phenomenon to attract the spring coil 15 toward the inside of the diameter direction does not occur.

In the case of using the spring coil 15 made of non-magnetic material shown in FIG. 4, the operational voltage is more increased when the value α exceeds 0.4. This means that a force of attracting the wound wire adjacent to each other in the axial direction of the spring coil 15 made of magnetic material by the electromagnetic force generated by the exciting coil 12. That is, because the attracting force generated between the adjacent wound wire forming the spring coil 15 made of magnetic material compensates the force reduced by the decreased area of the magnetic attraction surface 13*b*. Therefore the operational voltage corresponding to the increase of the value α is decreased even if the value α exceeds 0.4. However, the attracting force is decreased by the decreased area of the magnetic attraction surface 13*b* when the value α exceeds 0.4 because no attracting force is generated between the adjacent wound wire in the axial direction of the spring coil 15 when the spring coil is made of non-magnetic material. As a result, the operational voltage is thereby decreased.

Effects of the First Exemplary Embodiment

The electromagnetic solenoid 10 mounted to the electromagnetic switch 1 according to the first exemplary embodiment of the present invention has the following improved structure.

The most outer peripheral part 13*d* of the magnetic attraction surface 13*b* in the movable iron core 13 is positioned inside than the most outer peripheral part 13*e* of the fitting part 13*c*. This structure makes it possible to suppress the spring coil 15 from being moved inside in the diameter direction by the most outer peripheral part 13*e* of the fitting part 13*c* formed in the movable iron core 13. In addition, this structure makes it possible to prevent the interference from the spring coil 15 to the most outer peripheral part 13*d* of the magnetic attraction surface 13*b*.

It is therefore possible for the movable iron core 13 of the electromagnetic solenoid 10 to be attracted toward and to be contacted with the fixed iron core 14 without any influence provided from the spring coil 15 toward the inside of the diameter direction of the electromagnetic switch 1. This makes it possible to prevent the operational voltage to move the movable iron core 13 of the electromagnetic solenoid 10 from being increased.

The electromagnetic solenoid 10 according to the first exemplary embodiment further has the improved structure in which the small-diameter part 13*f* has a cylindrical shape having an outer peripheral surface which is approximately in parallel to the moving direction of the movable iron core 13 toward the fixed iron core 14. This structure makes it possible to decrease the change of the distance or gap between the outer peripheral surface of the small-diameter part 13*f* and the spring coil 15, and therefore to securely prevent the interference from the spring coil 15 to the movable iron core 13.

In the improved structure of the electromagnetic solenoid 10 according to the first exemplary embodiment, the length of the decreased diameter surface 13*g* in the axial direction is longer than the length in the diameter direction between the most outer peripheral part 13*e* of the fitting part 13*c* and the most outer peripheral part 13*d* of the magnetic attraction surface 13*b* in the movable iron core 13. This improved structure makes it possible to securely prevent the interference transmitted from the spring coil to the movable iron core 13 of the electromagnetic solenoid 10 even if the spring coil 15 is compressed between the movable iron core 13 and the fixed iron core 14, and the distance between the adjacent wound wire forming the spring coil 15 is thereby decreased.

In the improved structure of the electromagnetic solenoid 10 according to the first exemplary embodiment, the projection part 19 having a tapered shape is formed in the magnetic attraction surface 13*b* of the movable iron core of the electromagnetic solenoid 10. Because it is possible to adjust the attraction force of the movable iron core 13 to the fixed iron core 14 according to the distance between them by adjusting the dimension and volume of the projection part 19, it is possible to provide easily work of designing the electromagnetic solenoid 10.

In the improved structure of the electromagnetic solenoid 10 according to the first exemplary embodiment, the spring coil 15 is made of magnetic material. This makes it possible to generate the attraction force between the adjacent wound wire forming the spring coil 15 in the axial direction by the electromagnetic force generated by the exciting coil 12. It is thereby possible to increase the attraction force generated between the movable iron core 13 of the electromagnetic solenoid 10 and the fixed iron core 14. In addition, even if the area of the magnetic attraction surface 13*b* is decreased, it is possible to prevent the attraction force generated between the movable iron core 13 and the fixed iron core 14 from being decreased.

In the improved structure of the electromagnetic solenoid 10 according to the first exemplary embodiment, the distance between the most outer peripheral part 13*e* of the fitting part 13*c* and the most outer peripheral part 13*d* of the magnetic attraction surface 13*b* in the movable iron core 13 is a value of not less than 0.6 times of the wire diameter of the spring coil 15. This makes it possible to securely prevent the interference from the spring coil 15 to the movable iron core 13 of the electromagnetic solenoid 10.

Second Exemplary Embodiment

A description will be given of the electromagnetic switch 1-1 equipped with the electromagnetic solenoid 10-1 and the electromagnetic relay 20 with reference to FIG. 5.

Figure 5:
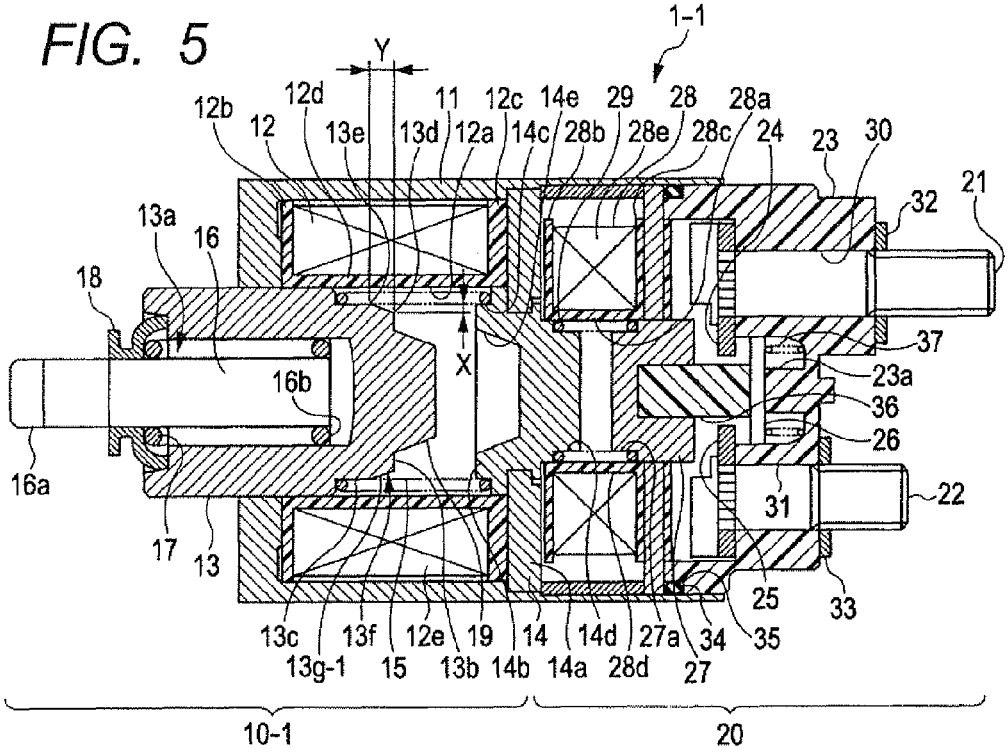
FIG. 5 is a view showing a cross section of an electromagnetic switch equipped with an electromagnetic solenoid and an electromagnetic relay according to a second exemplary embodiment of the present invention.

FIG. 5 is a view showing a cross section of the electromagnetic switch 1-1 equipped with the electromagnetic solenoid 10-1 and the electromagnetic relay 20 according to the second exemplary embodiment of the present invention.

In the structure of the electromagnetic switch 1-1 equipped with the electromagnetic solenoid 10-1 according to the first exemplary embodiment shown in FIG. 1, the small-diameter part 13*f* is formed between the magnetic attraction surface 13*b* and the side part of the fitting part 13*c* which faces the fixed iron core 14. The small-diameter part 13*f* is smaller in diameter than the fitting part 13*c*. Further, the decreased-diameter surface 13*g* (or the decreased-diameter part) is formed approximately in parallel to the movable axis of the movable iron core 13 of the electromagnetic solenoid 10-1, where the decreased-diameter surface 13*g* is an outer peripheral surface of the movable iron core 13 at which the most outer peripheral part 13*d* of the magnetic attraction surface 13*b* and the most outer peripheral part 13*e* of the fitting part 13*c* are connected together.

On the other hand, the second exemplary embodiment shows the structure in which the decreased-diameter surface 13*g*-1 (decreased-diameter part) has a tapered shape formed toward the magnetic attraction surface 13*b* along the axial direction. Other components of the second exemplary embodiment are the same of the components of the first exemplary embodiment, and the explanation of these same components is omitted here for brevity.

FIG. 5 shows a cross section of the electromagnetic switch according to the second exemplary embodiment. As clearly shown in FIG. 5, the decreased-diameter surface 13*g*-1 (decreased-diameter part) has a tapered shape formed toward the magnetic attraction surface 13*b* along the axial direction.

This structure shown in FIG. 5 makes it possible to prevent the operational voltage to move the movable iron core 13 from being increased because the movable iron core 13 of the electromagnetic solenoid 10-1 can be attracted to the fixed iron core 14 without receiving any interference from the soul spring 15 toward the inside of the axial direction of the electromagnetic solenoid 10-1.

Third Exemplary Embodiment

A description will be given of the electromagnetic switch equipped with the electromagnetic solenoid and the electromagnetic relay with reference to FIG. 6.

Figure 6:
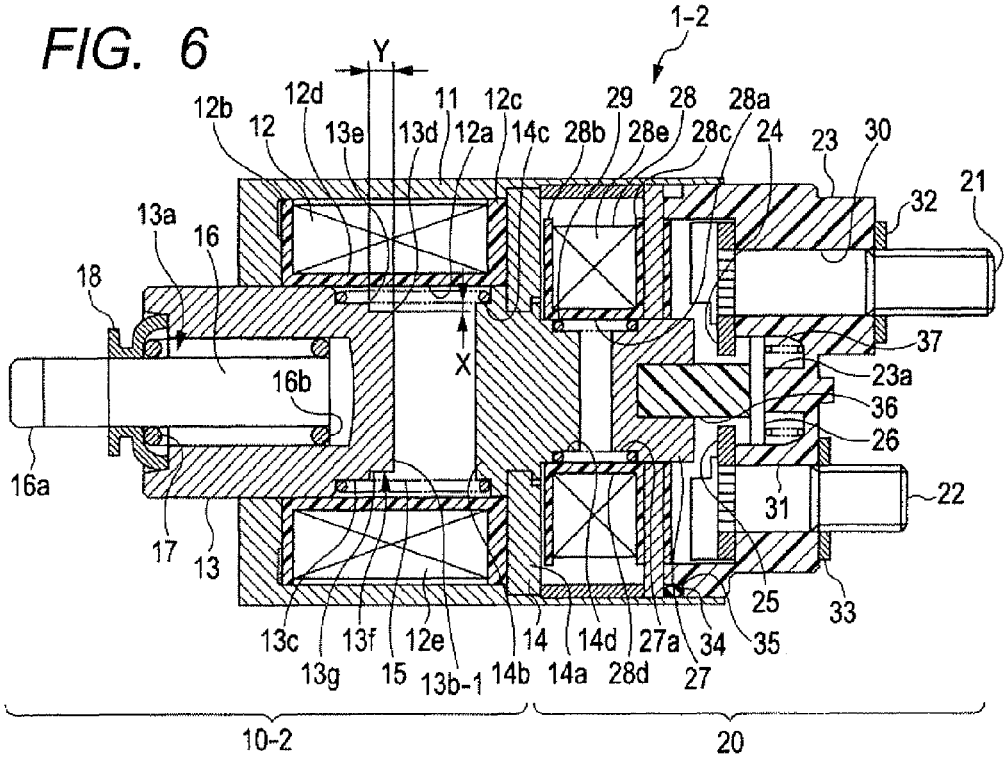
FIG. 6 is a view showing a cross section of an electromagnetic switch equipped with an electromagnetic solenoid and an electromagnetic relay according to a third exemplary embodiment of the present invention.

FIG. 6 is a view showing a cross section of the electromagnetic switch 1-2 equipped with the electromagnetic solenoid 10-2 and the electromagnetic relay 20 according to the third exemplary embodiment of the present invention.

In the structure of the electromagnetic switch 1-2 equipped with the electromagnetic solenoid 10-2 and the electromagnetic relay 20 according to the first and second exemplary embodiments, the magnetic attraction surface 13*b* of the movable iron core 13 of the electromagnetic solenoid 10-2 has the projection part 19 having a tapered shape which projects toward the fixed iron core 14 along the axial direction.

On the other hand, the third exemplary embodiment shows the magnetic attraction surface 13*b*-1 without a projection part. Other components of the second exemplary embodiment are the same of the components of the first exemplary embodiment, and the explanation of these same components is omitted here for brevity.

In structure of the electromagnetic switch 1-2 equipped with the electromagnetic solenoid 10-2 and the electromagnetic relay 20 according to the third exemplary embodiment shown in FIG. 6, the magnetic attraction surface 13*b*-1 has no projection part, namely, has a flat surface.

In particular, FIG. 6 shows the structure in which the decreased-diameter surface 13*g* (decreased-diameter part) is formed approximately in parallel to the movable axis of the movable iron core 13 of the electromagnetic solenoid 10-2.

Figure 7:
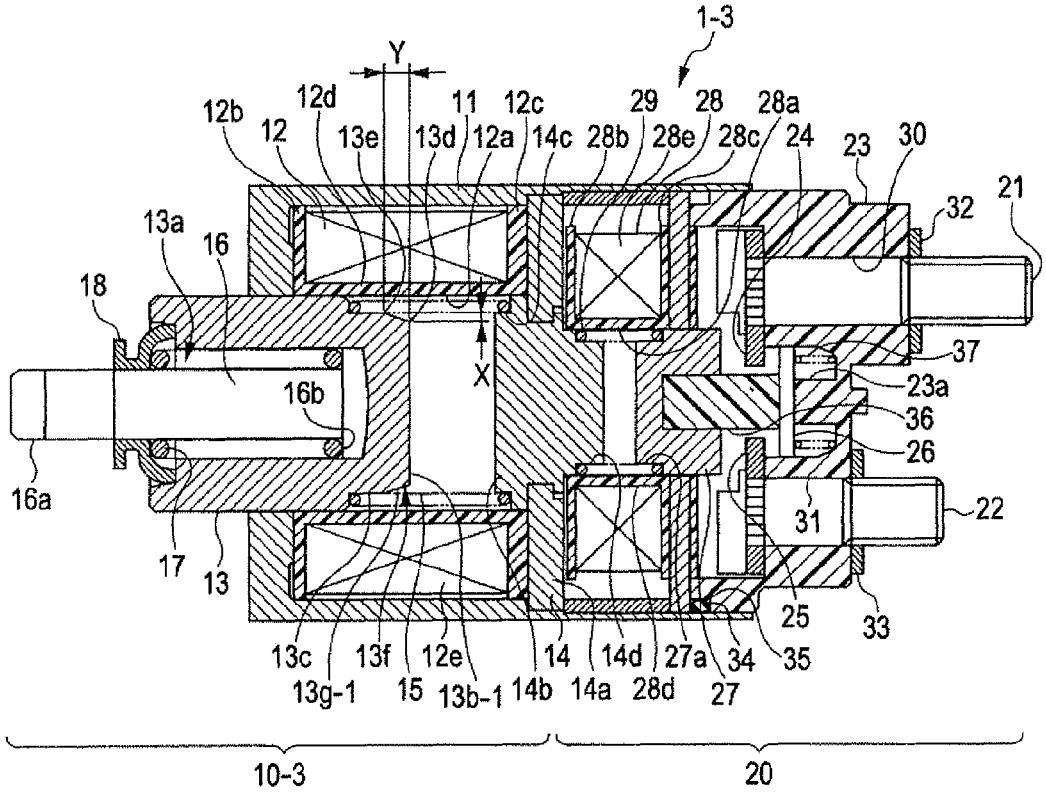
FIG. 7 is a view showing a cross section of the electromagnetic switch equipped with the electromagnetic solenoid according to a modification of the third exemplary embodiment of the present invention.

FIG. 7 is a view showing a cross section of the electromagnetic switch 1-3 equipped with the electromagnetic solenoid 10-3 according to a modification of the third exemplary embodiment of the present invention.

FIG. 7 shows the structure in which the decreased-diameter surface 13*g*-1 (decreased-diameter part) has a tapered shape formed toward the magnetic attraction surface 13*b* along the axial direction.

Like the structure of the first exemplary embodiment shown in FIG. 1, the structure of the electromagnetic solenoid according to the third embodiment shown in FIG. 6 and FIG. 7 makes it possible to attract the movable iron core 13 of the electromagnetic solenoid 10-3 and be contacted with the fixed iron core 14 without influence from the spring coil 15 in the inside along the diameter direction. This makes it possible to prevent the operational voltage to move the movable iron core 13 from being increased.

(Other Modifications)

The first to third exemplary embodiments previously described show the cases in which the electromagnetic solenoid is applied to an electromagnetic solenoid mounted to a starter motor with which the internal combustion engine of a motor vehicle is started. However, the subject matter of the present invention is not limited by the above exemplary embodiments. The electromagnetic solenoid according to the present invention can be applied to various applications in which a movable iron core is moved along an axial direction of the electromagnetic solenoid by magnetic force generated by exciting coil. For example, the electromagnetic solenoid according to the present invention can be applied to an electromagnetic relay, as explained in the first exemplary embodiment.

In the first to third exemplary embodiments previously described, the bobbin 12*d* is made of resin. However, the subject matter of the present invention is not limited by the above exemplary embodiments. It is possible that the bobbin is formed by metal member or metallic member. When the bobbin is made by metal material, it is acceptable that the surface of the bobbin is coated with electrical insulation paint.

Further, the first to third exemplary embodiments previously described use the wire 12*e* made of enameled wire in which an electric wire is coated with insulation enamel. However, the subject matter of the present invention is not limited by the above exemplary embodiments. It is possible that the wire 12*e* is made of aluminum wire.

In the first to third exemplary embodiments previously described, the disk part 14*a* of the fixed iron core 14 has a stacked structure in which a plurality of thin plates is stacked. However, the subject matter of the present invention is not limited by the above exemplary embodiments. It is possible that the disk part 14*a* of the fixed iron core 14 is made of a single member.

In the first to third exemplary embodiments previously described, the electromagnetic solenoid 10 and the electromagnetic relay 20 uses the fixed iron core 14 as a common magnetic circuit. However, the subject matter of the present invention is not limited by the above exemplary embodiments. It is possible that each of the electromagnetic solenoid 10 and the electromagnetic relay 20 uses a fixed iron core as its magnetic circuit.

In the first to third exemplary embodiments previously described, the contact cover 23 is made of resin as insulation member. However, the subject matter of the present invention is not limited by the above exemplary embodiments. It is possible that the contact cover is made of metal member and an insulation member is placed between the contact cover and the terminal bolds.

In the first embodiment previously described, the surface of the projection part 19 having a tapered shape is not contacted with the inner surface of the hole part 14*e* formed in the core part 14*b* of the fixed iron core 14. However, the subject matter of the present invention is not limited by the above exemplary embodiments. It is possible that the surface of the projection part 19 having a tapered shape is contacted with the inner surface of the hole part 14*e* formed in the core part 14*b* of the fixed iron core 14 in order to use the surface of the projection part 18 as a part of the magnetic attraction surface 13*b*.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. An electromagnetic solenoid comprising:

an electromagnetic coil forming an electromagnet when receiving electric power;

a fixed iron core arranged at one end part of the electromagnetic coil, and magnetized when electric power is supplied to the electromagnetic coil;

a movable iron core configured to be moved along the axial direction in the inside of the electromagnetic coil to and from the fixed iron core;

a spring coil placed between the fixed iron core and the movable iron core and supplying a spring force to the movable iron core toward an opposite direction of the fixed iron core along the axial direction;

a fitting part protruding from and having a maximum width perpendicular to the axial direction less than a maximum width of the at least one of the fixed iron core and the movable iron core in the same direction; and a magnetic attraction surface formed on a first surface of the at least one of the fixed iron core and the movable iron core facing the other iron core;

wherein the magnetic attraction surface is contacted with the other iron core when the movable iron core is attracted to and in contact with the fixed iron core;

the outer circumferential surface of the fitting part is in direct contact with the spring coil, and the maximum width of the magnetic attraction surface perpendicular to the axial direction is less than the maximum width of the fitting part in the same direction.

2. The electromagnetic solenoid according to claim 1, further comprising a small-diameter part protruding from the first surface of the fitting part and arranged between the magnetic attraction surface and the fitting;

wherein the maximum width of the small-diameter part perpendicular to the axial direction is less than the maximum width of the fitting part in the same direction.

3. The electromagnetic solenoid according to claim 2, wherein the small-diameter part has a cylindrical shape having an outer surface along the axial direction in which the movable iron core moves.

4. The electromagnetic solenoid according to claim 2, wherein a length of the small-diameter part in the axial direction is greater than the difference between the maximum width of the small-diameter part and the maximum width of the fitting part perpendicular to the axial direction.

5. The electromagnetic solenoid according to claim 1, wherein the magnetic attraction surface has a projection part having a tapered shape which projects axially toward the other iron core, and the other iron core further comprises a hole configured to receive the projection part when the movable iron core is attracted to and in contact with the fixed iron core.

6. The electromagnetic solenoid according to claim 1, wherein the spring coil is made of magnetic material.

7. The electromagnetic solenoid according to claim 1, wherein the difference between the maximum width of the fitting part and the maximum width of the magnetic attraction surface perpendicular to the axial direction is not less than 0.6 times of a wire diameter of the spring coil.

8. The electromagnetic solenoid according to claim 7, wherein the difference between the maximum width of the fitting part and the maximum width of the magnetic attraction surface perpendicular to the axial direction is within a range of not less than 0.6 times to 0.8 times of a wire diameter of the spring coil.

9. The electromagnetic solenoid of claim 1, wherein the maximum width of the fitting part perpendicular to the axial direction is the same for the length of the fitting part in the axial direction.

10. The electromagnetic solenoid of claim 2, wherein the maximum width of the small-diameter part perpendicular to the axial direction is the same for the length of the fitting part in the axial direction.

11. An electromagnetic solenoid comprising:

an electromagnetic coil;

a fixed iron core arranged at a first end of the electromagnetic coil and having a hole;

a movable iron core arranged at a second end of the electromagnetic coil and configured to be moved along the axial direction inside the electromagnetic coil;

a spring coil placed between a portion of the movable iron core and the fixed iron core, supplying a spring force to the movable iron core in the axial direction away from the fixed iron core;

a fitting part protruding from the movable iron core, having an outer circumferential surface in direct contact with the spring coil;

a small-diameter part protruding from a first surface of the fitting part facing the fixed iron core;

a magnetic surface formed on a surface of the small-diameter part opposite to the fitting part and configured to have a portion that contacts the fixed iron core when the movable iron core is attracted to and in contact with the fixed iron core;

wherein a maximum width of the small-diameter part perpendicular to the axial direction is less than a maximum width of the fitting part in the same direction by a predetermined amount.

12. The electromagnetic solenoid of claim 11, wherein the predetermined amount is such that the maximum width of the magnetic attraction surface perpendicular to the axial direction is between 0.6 and 0.8 times the maximum width of the spring coil in the same direction.

13. The electromagnetic solenoid of claim 11, wherein the magnetic attraction surface comprises a projection surface projecting axially from the small-diameter part in the direction of the fixed iron core, wherein the maximum width of the projection surface perpendicular to the axial direction decreases in the direction of the fixed iron core.

14. The electromagnetic solenoid of claim 13, wherein the hole is shaped to receive the projection surface when the movable iron core is attracted to and in contact with the fixed iron core.

15. The electromagnetic solenoid of claim 13, wherein the projection surface is tapered such that its maximum width perpendicular to the axial direction closest to the small-diameter part is greater than its maximum width in the same direction farthest from the small-diameter part.

16. The electromagnetic solenoid of claim 11, wherein the maximum width of the fitting part perpendicular to the axial direction is the same for the length of the fitting part in the axial direction.

17. The electromagnetic solenoid of claim 12, wherein the maximum width of the small-diameter part perpendicular to the axial direction is the same for the length of the fitting part in the axial direction.

* * * * *